US005628515A

United States Patent [19]

Levy

[11] Patent Number: 5,628,515

[45] Date of Patent: May 13, 1997

[54] SOCCER TRAINING SYSTEM

[76] Inventor: Carey Levy, 28062 Hastings, Mission Viejo, Calif. 92692

[21] Appl. No.: 596,948

[22] Filed: Feb. 5, 1996

[51] Int. Cl.[6] ..... A63B 69/00

[52] U.S. Cl. ..... 473/446; 273/392; 273/400

[58] Field of Search ..... 273/394, 395, 273/396, 400, 411, 57.2, 392

[56] References Cited

U.S. PATENT DOCUMENTS

| | | | |
|---|---|---|---|
| 4,607,842 | 8/1986 | Daoust | 273/57.2 |
| 4,615,528 | 10/1986 | York | 273/396 |
| 4,842,283 | 6/1989 | Label et al. | 273/392 |
| 4,921,257 | 5/1990 | Heller | 273/401 |
| 4,948,147 | 8/1990 | Pallanca | 273/402 |
| 5,197,744 | 3/1993 | Nanau | 273/396 |
| 5,271,624 | 12/1993 | Sciortino | 273/26 A |
| 5,503,402 | 4/1996 | Moss, Jr. | 273/400 |

*Primary Examiner*—William H. Grieb
*Attorney, Agent, or Firm*—Goldstein & Associates

[57] ABSTRACT

A soccer training device, for mounting to a soccer goal, comprising a visual target, a clamp, and a tapered stem between the visual target and clamp. The clamp has a pair of jaws capable of opening and closing to attach the soccer training device onto a soccer goal. The clamp is attached to the tapered stem with a hinge, which allows the visual target to deflect with respect to the clamp when hit with a soccer ball. The device is clamped onto a soccer goal to remind a player to aim for extremities of the soccer goal.

5 Claims, 1 Drawing Sheet

SOCCER TRAINING SYSTEM

BACKGROUND OF THE INVENTION

The invention relates to a soccer training system. More particularly, the invention relates to a device which attaches to a soccer goal to provide a visual objective for a soccer player kicking a goal.

Soccer is the most widely played and viewed sport worldwide. Although its popularity is just beginning to explode in the United States, over 100 million people play soccer in over 175 countries.

Learning to play soccer involves developing a variety of skills. Hand, eye, leg, and body coordination are crucial to success in the sport. Many ball handling skills must be developed, including "shooting".

Scoring in soccer is achieved by kicking the ball into the opponents goal. Naturally, like all goal-oriented sports, the goal is protected by a goalkeeper, whose job is to prevent the ball from reaching the goal. One of the most common mistakes made by beginning soccer players "goalkicking", is to aim for the goalkeeper. It is only natural to focus on a target, and the goalkeeper often provides such a target for the fledgling player. Kicking the ball directly at the goalkeeper is a sure recipe for failure, and is a very bad habit for a beginning player to develop. However, to date no effective system has been developed to combat this problem.

U.S. Pat. No. 5,271,624 to Sciortino attempts to combat this problem by providing a large, weighted target strip which hangs from the upper horizontal member of the goal post, and has movable bands for indicating the upper and lower boundaries within which to aim the goalkick. The apparatus is large and combersome, and is aimed at the different purpose of having a player aim the ball within a precise region in the goal, rather than to remind the player to kick the ball at the extremities.

While these units may be suitable for the particular purpose employed, or for general use, they would not be as suitable for the purposes of the present invention as disclosed hereafter.

SUMMARY OF THE INVENTION

It is an object of the invention to produce a system for training soccer players to aim for the extremities of the goal, rather than at the center, when making a goalkick.

It is another object of the invention to provide a soccer training system which provides a visual target for the player.

It is a further object of the invention that the visual target is easily attachable to the framework of the goal, and removable therefrom when not in use.

It is a still further object of the invention to deflect the force of an impacting soccer ball, so that the visual target is durable and has a long useful life.

The invention is a soccer training device, for mounting to a soccer goal, comprising a visual target, a clamp, and a tapered stem between the visual target and clamp. The clamp has a pair of jaws capable of opening and closing to attach the soccer training device onto a soccer goal. The clamp is attached to the tapered stem with a hinge, which allows the visual target to deflect with respect to the clamp when hit with a soccer ball. The device is clamped onto a soccer goal to remind a player to aim for extremities of the soccer goal.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
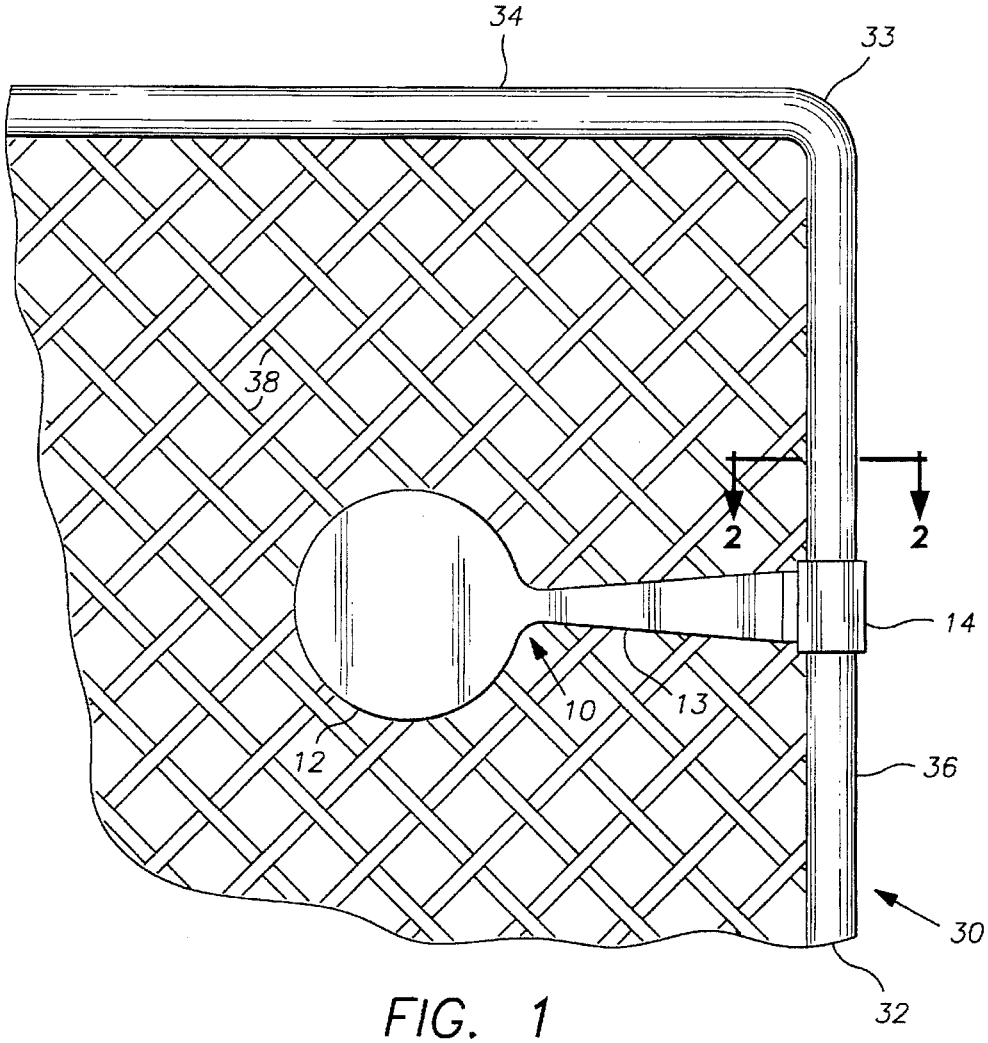
FIG. 1 is a front elevational view of the invention, installed in a soccer goal, and ready to use.

FIG. 1 illustrates a soccer training device 10. The soccer training device comprises a visual target 12 and a clamp 14. The visual target 12 is attached to the clamp 14 with a tapered stem 16, the tapered stem 16 being tapered from the visual target 12 toward the clamp 14. Preferably the visual target 12 and tapered stem 16 are molded from a single piece of plastic. The visual target 12 is circular and is preferably ¼ to 3 times the size of a regulation soccer ball.

The soccer training device 10 is attached to a goal 30, comprising a goal post 32 having a horizontal member 34 and a vertical member 36, the junction of which forms a corner 33. Netting material 38 is attached to the goal post 32, and defines a goal inner space.

Figure 2:
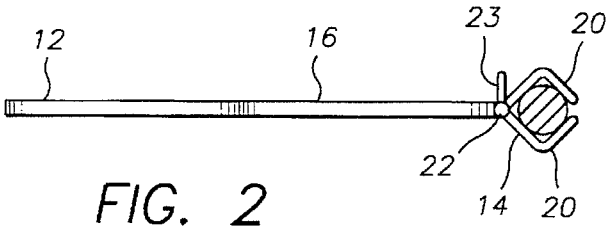
FIG. 2 is a cross sectional view taken along line 2—2 in FIG. 1.

FIG. 2 illustrates the clamp 14 attached to the vertical member 36 of the goal post 32. The clamp 14 comprises two jaws 20 attached by a hinge 22. Each jaw 20 forms a right angle, and the two jaws 20 form a square when the clamp 14 is closed. The clamp 14 has an opening tab 23, affixed to one of the jaws 20, to allow the clamp to be opened so that it may be easily attached on or removed from the goal post 32. In addition to allowing the jaws 20 to move with respect to one another to open and close the clamp 14, the hinge 22 allows the visual target 12 and tapered stem 16 to pivot about the hinge 22 to allow the visual target 12 to deflect upon impact. Typically though, the hinge 22 would actually comprise two pivot points, one to allow the jaw to open and close, and another which allows the visual target 12 to deflect.

Figure 3:
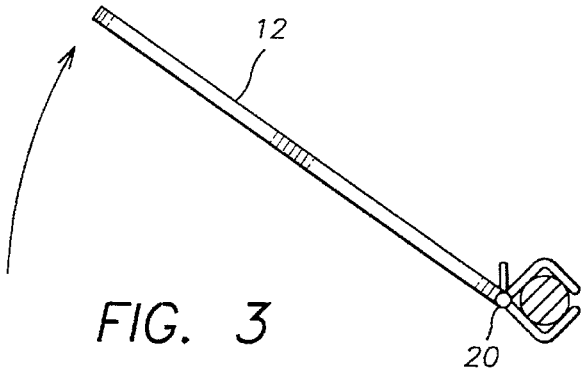
FIG. 3 is a cross sectional view, similar to FIG. 2, except wherein the invention has undergone an impact from a soccer ball.

FIG. 3 illustrates the soccer training device 10 after the visual target 12 has received an impact from a soccer ball. The visual target has deflected the impact by pivoting about the hinge 22.

The soccer training device 10 functions by providing a target for the soccer player to aim for. In other words, rather than aiming for the goalie standing in the center of the goal, the player will aim for the visual target 12 mounted near the corners or extremities of the soccer goal. A goalkick aimed at the corners is more likely to get past the goalie than a goalkick aimed at the center of the goal, where the goalie is standing.

In conclusion, herein is presented a system for effectively improving the skills of a beginning soccer player. Namely, the disclosed invention trains the soccer player to aim for the extremities of the goal, rather than the center, where greater goalkicking success can be achieved.

What is claimed is:

1. A soccer training device, for attaching to a soccer goal post comprising:

a visual target;

a clamp attached to the visual target, the clamp having a pair of jaws for attaching onto the goal post; and a tapered stem attached to and extending between the visual target and the clamp.

2. The soccer training device as recited in claim 1, wherein the clamp is attached to the tapered stem with a hinge, the hinge allowing the visual target to deflect with respect to the clamp when the visual target is hit by a soccer ball.

3. The soccer training device as recited in claim 2, wherein each jaw forms a right angle, and the clamp forms a square when the clamp is closed.

4. A soccer training method, using a training device having a visual target attached to a clamp With a tapered stem, and using a soccer goal having horizontal members, vertical members attached between the horizontal members, and corners near the horizontal members, comprising the steps mounting the visual target near the corners of the goal by attaching the clamp onto one of the vertical members; and aiming a goalkick at the visual target.

5. The soccer training method as recited in claim 4, wherein netting material extends between the horizontal members and vertical members defining a goal inner space, and wherein the step of mounting the visual target further comprises extending the visual target from one of the vertical members into the goal inner space.

* * * * *